US011519201B2

(12) United States Patent
Fuchs et al.

(10) Patent No.: US 11,519,201 B2
(45) Date of Patent: Dec. 6, 2022

(54) MOTOR VEHICLE DOOR LOCK

(71) Applicant: Kiekert AG, Heiligenhaus (DE)

(72) Inventors: Carsten Fuchs, Essen (DE); Dirk Eichel, Velbert (DE)

(73) Assignee: Kiekert AG, Heiligenhaus (DE)

( * ) Notice: Subject to any disclaimer, the term of this patent is extended or adjusted under 35 U.S.C. 154(b) by 583 days.

(21) Appl. No.: 16/485,858

(22) PCT Filed: Feb. 2, 2018

(86) PCT No.: PCT/DE2018/100084
§ 371 (c)(1),
(2) Date: Aug. 14, 2019

(87) PCT Pub. No.: WO2018/149443
PCT Pub. Date: Aug. 23, 2018

(65) Prior Publication Data

US 2020/0056404 A1 Feb. 20, 2020

(30) Foreign Application Priority Data

Feb. 14, 2017 (DE) ..... 10 2017 102 899.4

(51) Int. Cl.
*E05B 77/06* (2014.01)
*E05B 77/12* (2014.01)
*E05B 77/38* (2014.01)

(52) U.S. Cl.
CPC ..... *E05B 77/06* (2013.01); *E05B 77/12* (2013.01); *E05B 77/38* (2013.01)

(58) Field of Classification Search
CPC ..... E05B 77/06; E05B 77/12; E05B 77/38
See application file for complete search history.

(56) References Cited

U.S. PATENT DOCUMENTS

2015/0240536 A1* 8/2015 Cumbo ..... E05B 85/20 292/200
2015/0308161 A1 10/2015 Rosales

FOREIGN PATENT DOCUMENTS

DE 29622837 U1 7/1997
DE 202009009061 U1 12/2010
DE 102011010797 A1 8/2012
(Continued)

OTHER PUBLICATIONS

International Search Report and Written Opinion for corresponding Patent Application No. PCT/DE2018/100084 dated May 18, 2018.

*Primary Examiner* — Kristina R Fulton
*Assistant Examiner* — Thomas L Neubauer
(74) *Attorney, Agent, or Firm* — Renner, Otto, Boisselle & Sklar, LLP

(57) ABSTRACT

A motor vehicle door lock, comprising a locking mechanism, which essentially consists of a rotary latch and a pawl, and further comprising an actuation lever mechanism acting on the locking mechanism, and an inertia element. Said inertia element, during normal operation, follows a movement of the actuation lever mechanism. At high accelerations, for example in the event of a crash, the inertia element blocks the actuation lever mechanism acting on the locking mechanism. According to the invention, an elastic damping element is connected to the actuation lever mechanism. Said damping element abuts the inertia element at least in the event of a crash for the purpose of damping vibrations.

19 Claims, 4 Drawing Sheets

(56) References Cited

FOREIGN PATENT DOCUMENTS

Figure 1:
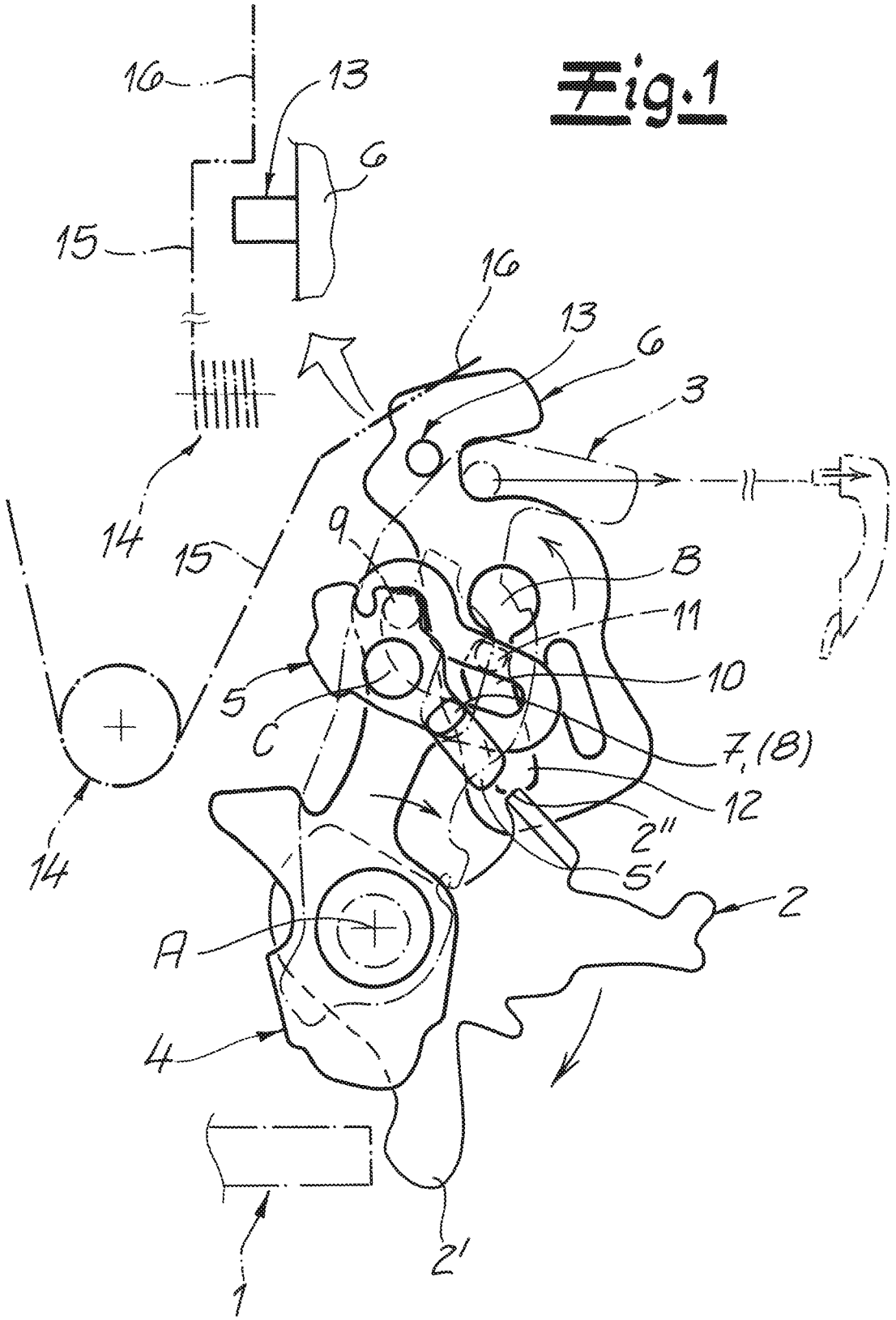

| | | | | | |
|---|---|---|---|---|---|
| DE | 102011100090 | A1 | | 10/2012 | |
| DE | 102015001318 | A1 | | 8/2016 | |
| DE | 102015109946 | A1 | | 12/2016 | |
| EP | 2248972 | A2 | | 11/2010 | |
| EP | 3067493 | A1 | | 9/2016 | |
| WO | 2015/090286 | A1 | | 6/2015 | |
| WO | WO-2015090286 | A1 | * | 6/2015 | ..... E05B 77/06 |
| WO | 2015127916 | A1 | | 9/2015 | |

* cited by examiner 16
13
6
15
16
13
6
3
14
15
9
B
11
10
5
C
7,(8)
12
2''
5'
2
14
A
4
1
2'

MOTOR VEHICLE DOOR LOCK

The invention relates to a motor vehicle door lock, comprising a locking mechanism, which essentially consists of a rotary latch and a pawl, and further comprising an actuation lever mechanism acting on the locking mechanism and an inertia element, whereby the inertia element, during normal operation, follows a movement of the actuation lever mechanism and at high accelerations, for example, in the event of a crash, the inertia element blocks the actuation lever mechanism from acting on the locking mechanism.

The actuation lever mechanism usually consists of one or more actuation levers. These actuation levers are not restricted to at least an internal actuation lever, an external actuation lever and a trigger lever. Furthermore, there are usually one or more coupling levers. The actuation lever mechanism is generally moved via an outer door handle or an inner door handle.

If the actuation lever mechanism is actuated, the locking mechanism can be opened in this manner. For this purpose, the trigger lever usually engages a pawl of the locking mechanism and lifts the pawl from the related rotary latch. The rotary latch then opens in a spring-assisted manner and releases a previously engaged locking bolt. This enables the opening of a motor vehicle door equipped with the relevant motor vehicle lock.

If there are high accelerations or acceleration forces, for example, in the event of a crash, the motor vehicle door lock is subjected to considerable mass forces. These mass forces may lead to the mechanical failure of the locking mechanism and/or actuation lever mechanism. There is also a risk of the locking mechanism being opened unintentionally.

There is an inertia element in order to avoid such an unintentional opening of the locking mechanism, especially in the event of a crash. The inertia element ensures that the actuation lever mechanism is decoupled at the relevant high accelerations, for example, in the event of a crash. Thus the actuation lever mechanism or the trigger lever as part of the actuation lever mechanism cannot act on the locking mechanism. In this manner, an unintentional opening of the related motor vehicle door is avoided and the vehicle occupants are optimally protected.

Motor vehicle door locks of the initially described structure are indicated in a variety of designs in the relevant documentation. Thus, for example, the innovative theory according to DE 10 2011 100 090 A1 proceeds in such a manner that the inertia element or local blocking means is variable in terms of its form. The blocking means or inertia element is moved in its normal form with the actuation lever mechanism without a function. If, however, the blocking means or inertia element assumes its blocking form, the actuation lever mechanism is set so that it is inoperative. The known embodiment has proved successful, but is designed in a complex manner in terms of its constructive implementation.

In the case of a comparable motor vehicle door lock according to WO 2015/127 916 A1, the inertia element enables the blocking of a movement of the external actuation lever as part of an actuation lever mechanism. For this purpose, a coupling link is arranged in detail on the external actuation lever. The coupling link can be engaged with a trigger lever at a normal actuation speed of the external actuation lever. For this purpose, the coupling link acts on the trigger lever at the normal actuation speed, while under the influence of a spring tension.

A similar motor vehicle door lock as described above is the subject of EP 2 248 972 A2. In this case, there is also an inertia element by means of which a movement of the related external actuation lever can be unlocked. —As in the previously discussed state of the art, the design effort is considerable.

The state of the art thus far cannot satisfy in all aspects. Thus structurally complex solutions are usually pursued on the one hand. On the other hand, there is a risk for the relevant motor vehicle door locks that vibrations of the external actuation lever in particular may still lead to an unintentional opening of the locking mechanism. This is especially true in the event of a crash.

This means that, in the event of a crash, the inertia element currently ensures that the actuation lever mechanism is unlocked as intended. Since in the event of a crash, however, more or less strong vibrations or oscillations of the external actuation lever and thus of the actuation lever mechanism can often occur in the overall event, there is a risk that these vibrations may be transferred to the inertia element which, in normal operation, follows the movement of the actuation lever mechanism and is mechanically coupled with it accordingly.

However, such vibrations of the actuation lever mechanism, and especially of the external actuation lever, can now result in uncontrolled movements of the inertia element due to the mechanical coupling with the actuation lever mechanism. In the worst-case scenario, this can lead to the aforementioned unintentional opening of the locking mechanism, which is exactly what should be avoided. This is where the invention is used.

The invention is based on the technical problem of further developing a motor vehicle door lock of this type in such a manner that, for a simple structure in constructive terms, the operational reliability is increased compared to previous designs and, in particular, that unintentional openings of the locking mechanism can be reliably avoided in the event of vibrations of the actuation lever mechanism.

To solve this technical problem, there is a class-specific motor vehicle door lock in the context of the invention which is characterized by the provision of an elastic damping element connected to the actuation lever mechanism, which abuts the inertia element, at least in the event of a crash, in order to increase the inertia. This makes the motor vehicle door lock less sensitive to vibrations of, for example, the external actuation lever.

According to the invention, an additional elastic damping element is thus used. The damping element is connected to the actuation lever mechanism and follows the movements of the actuation lever mechanism accordingly. The design is frequently created in such a manner that, in normal operation and for a related movement of the actuation lever mechanism, the moved elastic damping element does not abut the inertia element or does not mechanically interact with the inertia element.

In fact, normal operation generally corresponds to the fact that the actuation lever mechanism is moved and the inertia element essentially follows the movement of the actuation lever mechanism. As a result, there is no interaction between the elastic damping element and the inertia element. Instead, in normal operation, the relevant damping element and the inertia element are usually separated from each other or do not come into contact with each other mechanically.

The event of a crash now generally corresponds to the fact that the inertia element remains at rest due to its inertia. On the other hand, the actuation lever mechanism or individual levers of this actuation lever mechanism can move, for example, the external actuation lever. Due to the movement of the external actuation lever in comparison to the more or less resting inertia element, there is regular mechanical contact between the elastic damping element and the relevant inertia element. This is because the actuation lever mechanism has at least one actuation lever to which the elastic damping element is connected.

The relevant lever with the connected elastic damping element involves the external actuation lever in particular. If the external actuation lever is now swiveled with the connected elastic damping element in the event of a crash, this swivel movement ensures, in comparison to the inertia element that remains at rest on the other hand, that the elastic damping element on the external actuation lever comes into contact mechanically with the inertia element. As a result, the elastic damping element abuts the inertia element, at least in the event of a crash. This is mainly used to apply an additional moment to the moment of inertia.

This means that, even if in the described event of a crash and in a system of the elastic damping element on the inertia element, the external actuation lever vibrates or oscillates, any movements of the inertia element triggered by this due to an increase in its inertia are at least damped or inhibited. In addition, the elastic damping element ensures that the inertia element as a whole is inhibited in terms of its possible movement, at least in the event of a crash and usually also before and after it.

Since the decoupling of the actuation lever mechanism as a whole is ensured by the inertia element which is thus guided so to speak over a longer period of time in comparison to the state of the art and inhibited in its movement, the blockade of the actuation lever mechanism is also extended in terms of time in comparison to the state of the art and increases overall safety as a result. This is because the oscillating movements on the external actuation lever in the example do not affect the inertia element or the actuation lever mechanism decoupled from it. As a result, there is no unintentional opening of the lock as desired and the operational reliability is significantly increased compared to previous variants. These are the fundamental advantages.

In accordance with an advantageous design, the actuation lever equipped with the elastic damping element as part of the actuation lever mechanism is usually optionally connected via a coupling lever with a trigger lever for the locking mechanism. The coupling lever is guided in turn by a control lever. The control lever interacts with the inertia element and forms a transmission.

In the event of a crash and the resulting rest status of the inertia element, a movement of the actuation lever or external actuation lever ensures that the elastic damping element connected to the external actuation lever abuts the inertia element according to the invention. The associated relative movement of the actuation lever or external actuation lever with respect to the resting inertia element leads to the coupling lever being decoupled from the trigger lever, and thus the movement of the actuation lever or external actuation lever does not result in an opening of the locking mechanism. This applies to the event of a crash and as long as the inertia element remains mostly at rest or is inhibited in its movement by means of the elastic damping element.

In normal operation, however, the inertia element is moved with the actuation lever mechanism. Here, the actuation lever or external actuation lever is coupled via the coupling lever with the trigger lever for the locking mechanism. In this case, the coupling lever can thus act on the trigger lever and open the locking mechanism.

The elastic damping element can be designed as desired. Thus it is conceivable that this is an element made of an elastomer plastic. However, it is advantageous that the elastic damping element is designed as a spring. One design has proved to be particularly favorable, whereby the spring is formed as a leg spring with at least one spring leg connected to a base.

In this manner, therefore, the spring leg can mechanically interact with a blockade contour of the inertia element in the event of a crash. For this purpose, the spring leg is advantageously angled in the direction of the inertia element or the aforementioned blockade contour.

Thus as soon as the already described relative movement between the actuation lever or external actuation lever and the inertia element occurs, and the blockade contour abuts the inertia element as a result, the spring leg can attach itself to the blockade contour. The spring leg is generally deflected and/or deformed in the process. As a result, the actuation lever or external actuation lever and the inertia element are elastically coupled by means of the spring or the damping element. Any vibration movements of the actuation lever are absorbed and damped by this elastic coupling. In addition, the inertia element is inhibited in its possible movements.

As a result, the inertia element retains its desired resting functional position related to the event of a crash. This means that the coupling lever mechanically connected to the actuation lever in its disengaged or uncoupled position is held properly compared to the trigger lever for the locking mechanism, and an unintentional opening of the lock and thus of the motor vehicle door is definitely avoided. These are the fundamental advantages.

Figure 2:
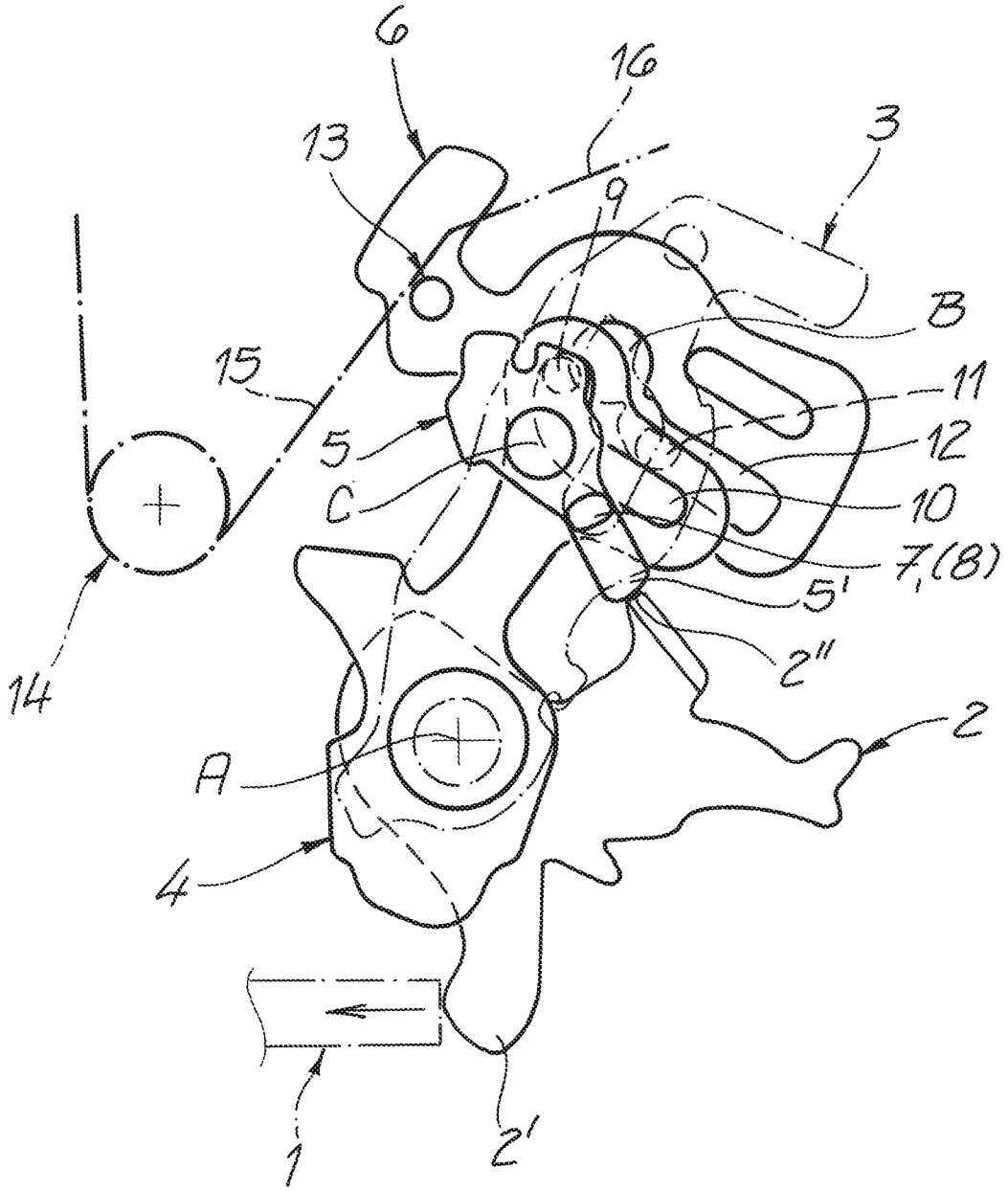
Figure 3:
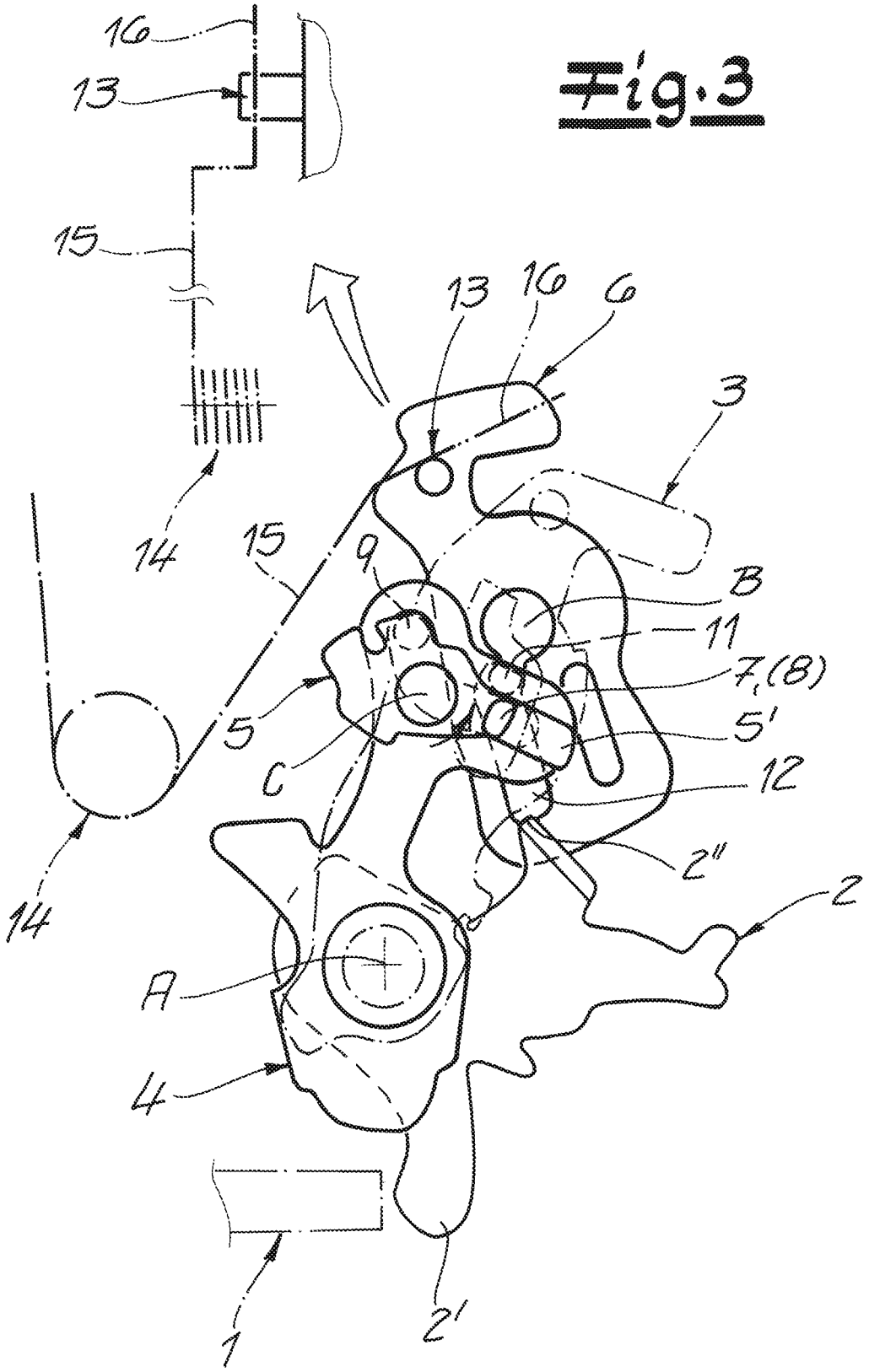
Figure 4:
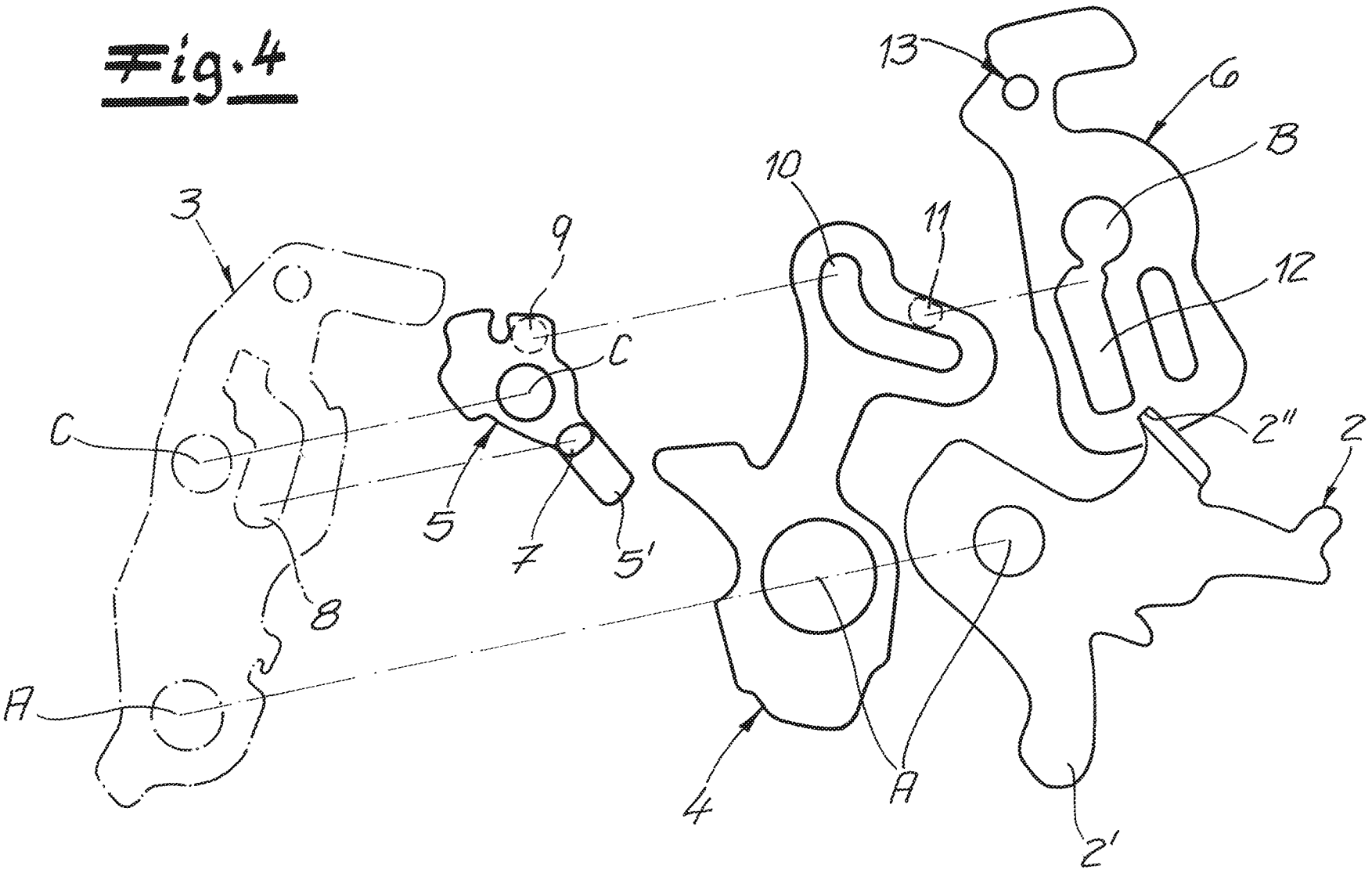

Hereinafter, the invention is explained in further detail on the basis of a drawing which only depicts an exemplary embodiment; it shows:

FIG. 1 the inventive motor vehicle door lock in its resting position in normal operation, FIG. 2 the motor vehicle door lock according to FIG. 1 in normal operation in a deflected or actuated functional position, FIG. 3 the motor vehicle door lock according to FIGS. 1 and 2 in the event of a crash and FIG. 4 the individual levers for the realization of the motor vehicle door lock according to FIGS. 1 to 3.

The figures show a motor vehicle door lock, which is equipped with a locking mechanism 1 only indicated in FIGS. 1, 2 and 3, which essentially consists of a rotary latch and a pawl. From the locking mechanism 1, one mainly recognizes a pawl, which interacts in the usual manner with the rotary latch that is not explicitly shown.

A trigger lever 2 acts on the locking mechanism 1. As soon as the trigger lever 2 performs a swivel movement clockwise around its axis A as indicated in FIG. 1, the trigger lever 2 strikes the pawl with its actuating arm 2' and ensures that the pawl previously applied in the rotary latch is lifted off from the rotary latch. The rotary latch can then open in a spring-assisted manner and release a previously engaged locking bolt. The motor vehicle door equipped with the relevant motor vehicle door lock can be opened as follows.

In order to swivel the trigger lever 2 clockwise around its axis A as indicated in FIG. 1 and thus open the locking mechanism 1, an actuating lever 3 is applied in the pulling sense, as indicated by an arrow in FIG. 1. This pulling movement is exerted on the actuation lever 3 in the exemplary embodiment by means of an outer door handle that is only indicated, which is thus not restrictively formed as external actuation lever 3.

For this purpose, the actuation lever or external actuation lever 3 is accommodated in the same axis in comparison to trigger lever 2, thus reverting to the common axis A. Thus the actuation lever 3 also performs a swivel movement clockwise around the axis A when pulling the indicated outer door handle.

The actuation lever or external actuation lever 3 is optionally coupled via a coupling lever 5 to the trigger lever 2 for the locking mechanism 1 or decoupled from the trigger lever 2, as this is described further in more detail below. In addition to the coupling lever 5, there is also a control lever 4, which is guided by means of the coupling lever 5. Finally, the basic structure includes an inertia element 6, the function of which is explained in more detail below.

The trigger lever 2, the actuation lever or external actuation lever 3 and the control lever 4 as well as the coupling lever 5 define an overall actuation lever mechanism 2, 3, 4, 5, which acts on the locking mechanism 1 or can open the locking mechanism 1. For this purpose, the actuation lever or external actuation lever 3 is arranged above the coupling lever in the front view according to FIG. 1. The coupling lever 5 is located between the actuation lever or external actuation lever 3 and the control lever 4, which ensures the guidance of the coupling lever 5. The trigger lever 2 is accommodated in a parallel plane like the coupling lever 5, so there is the option of whether or not the coupling lever 5 can act on the trigger lever 2. The lowest plane contains the inertia element 6.

The inertia element 6 can be pivoted around an axis B. The coupling lever 5 in turn has a further axis C, by means of which it can be pivoted around the actuation lever or external actuation lever 3.

In addition, the coupling lever 5 engages with an elevated pin 7 opposite the drawing plane in FIG. 1 in a recess 8 in the actuation lever or external actuation lever 3 located above it. On the other hand, another control pin 9 provided on the coupling lever 5 protrudes downwards and can thus engage in another control recess 10 in the control lever 4 located below the coupling lever 5. Finally, there is a guide pin 11, which is arranged on the control lever 4 and extends downwards from there, and thus engages in a related guide recess 12 in the inertia element 6.

First, the operating principles in normal operation are explained based on FIGS. 1 and 2. In FIG. 1, the motor vehicle door lock is in its resting position or basic position with the non-deflected actuation lever mechanism 2, 3, 4, 5. In order to open the locking mechanism 1 starting from the representation in FIG. 1, the outer door handle acts in a pulling manner on the actuation lever or external actuation lever 3. As a result, the relevant external actuation lever 3 is swiveled clockwise around the axis A as indicated in FIG. 1, as indicated by an arrow in FIG. 1.

In FIG. 2, the end position of the actuation lever mechanism 2, 3, 4, 5 is shown in normal operation in which the actuation lever mechanism 2, 3, 4, 5 is deflected. It is evident that the clockwise movement of the external actuation lever 3 around axis A, initiated by means of the outer door handle 3, is first transferred to the coupling lever 5, which can be pivoted around axis C on the external actuation lever 3, and thus the swivel movement of the external actuation lever 3 follows. During this process, the control lever 4 is driven in the same manner and also performs a swivel movement clockwise around the common axis A.

This is because the coupling lever 5 engages with its control pin 9 in the control recess 10, or a protrusion of the control recess 10 adapted to the control pin 9, in the control lever 4, so that the control lever 4 is driven. In addition, the elevated pin 7 of the coupling lever 5 abuts an edge of the recess 8 of the external actuation lever 3 located above it, so that the coupling lever 5 together with the external actuation lever 3, which is guided as a whole through the control lever 4 during the transition from FIG. 1 to FIG. 2, is swiveled to such an extent that a stop arm 5' of the coupling lever 5 drives against a stop edge 2 of the trigger lever 2.

Thus starting from the basic position or starting position according to FIG. 1 during the transition to the functional position according to FIG. 2 with the deflected actuation lever mechanism 2, 3, 4, 5, the trigger level 2, together with the external actuation lever 3 and the control lever 4, is swiveled clockwise around the common axis A. This enables the stop arm 2' of the trigger lever 2 to act on the locking mechanism 1 as described and open it.

In addition to the common swivel movement of the external actuation lever 3 and the control lever 4 as well as the coupling lever 5, the inertia element 6 also performs a movement in normal operation according to the representation in FIGS. 1 and 2. The inertia element 6 actually follows the movement of the actuation lever mechanism 2, 3, 4, 5 in normal operation. The procedure within the scope of the exemplary embodiment is that the actuation lever or external actuation lever 3 with the mounted coupling lever 5 and the control lever 4 are swiveled clockwise as a whole around the common axis A. On the other hand, in normal operation and during the transition from the basic position according to FIG. 1 to the deflected position according to FIG. 2, the inertia element 6 performs a counterclockwise movement around its quasi-virtual axis B. This is indicated by another arrow in FIG. 1.

The counterclockwise movement of the inertia element 6 in normal operation is explained by the fact that the guide pin 11 that is connected to the control lever 4 engages downwards in the direction of the underlying inertia element 6 in the guide recess 12 of the inertia element 6. If the control lever 4 carrying the guide pin 11 is now swiveled from the basic position in FIG. 1 clockwise around the axis A, the guide pin 11 moves along a slit-shaped area of the guide recess 12 in the inertia element 6.

Since the slit-shaped area extends radially in relation to the rotary axis B of the inertia element 6, the inertia element 6 is swiveled counterclockwise around the axis or axis B here, as is clear from the transition from FIG. 1 to FIG. 2. As a result of this, the inertia element 6 is also swiveled each time it impinges on the actuation lever mechanism 2, 3, 4, 5, which has an advantageous effect on its consistent operation.

The inertia element 6 moves in the described counterclockwise movement around the axis B with a blockade contour arranged on the inertia element 6 spaced to an elastic damping element 14,15,16. The elastic damping element 14, 15, 16 is actually connected to the actuation lever mechanism 2, 3, 4, 5. In normal operation, there is now no mechanical contact between the blockade contour 13 and thus the inertia element 6 on the one hand with the elastic damping element 14, 15, 16 on the other hand. This is also clear based on the side view shown in detail and in parts in FIG. 1.

If, on the other hand, there is a crash as shown in FIG. 3, the relevant elastic damping element 14, 15, 16 abuts the inertia element 6 for the purpose of damping vibrations. In the functional position according to FIG. 3, the blockade contour 13 on the inertia element 16 actually mechanically interacts with the elastic damping element 14,15,16, which is explained in more detail below.

As already described, the elastic damping element 14,15, 16 is connected to the actuation lever mechanism 2, 3, 4, 5. In the exemplary embodiment, the external actuation lever 3, as a component of the actuation lever mechanism 2, 3, 4, 5, has the relevant elastic damping element 14, 15, 16. As a result of this, the relevant damping element 14, 15, 16 is moved together with the external actuation lever 3 and performs a clockwise swivel movement like the relevant lever 3 in normal operation and during the transition from the representation in FIG. 1 to FIG. 2. Since in normal operation and during the transition from FIG. 1 to FIG. 2, the inertia element 6 completes a counterclockwise movement around its axis B at the same time, the elastic damping element 14, 15, 16 and the inertia element 6 with its blockade contour 13 move towards each other.

It is evident when comparing the functional positions according to FIGS. 1 and 2 that the blockade contour 13 moves quasi-tangentially along a spring leg 15, 16 of the elastic damping element 14, 15, 16 that is designed as a spring. In any case, there is no mechanical contact, and the damping element 14, 15, 16 thus does not interact in normal operation with the blockade contour 13 or with the entire inertia element 6.

The spring 14,15,16 is formed according to the exemplary embodiment as a leg spring 14,15,16. The leg spring 14,15, 16 actually has at least one spring leg 15 connected to a base 14. The base 14 is characterized by several circular windings, which are particularly evident in the detailed side views in the representations according to FIGS. 1 and 3. According to the exemplary embodiment, two spring legs 15 are each tangentially connected to the relevant base 14. There is an acute angle between the two spring legs 15.

In addition, it is evident from the two side views in FIGS. 1 and 3 that an extension 16 is connected to the spring leg 15 on the right of the exemplary embodiment and to the spring leg 15 facing the actuation lever mechanism 2, 3, 4, 5.

The extension 16 is angled in the direction of the inertia element 6, so that the related spring leg 15, 16 is angled in the direction of the inertia element 6. In addition, the extension 16 is bent at right angles with respect to the spring leg 15 according to the side views in FIGS. 1 and 3.

While the spring leg 15 extends in a plane above the blockade contour 13 on the inertia element 6, the extension 16 can interact with the blockade contour 13 due to its being on a lower plane, as is evident from the side view according to FIG. 3. This is why the spring leg 15, 16 abuts the blockade contour 13 of the inertia element 6 in the event of a crash shown in FIG. 3 and is deflected or deformed here.

The event of a crash is described below. If one assumes the basic position of the motor vehicle door lock according to FIG. 1, high accelerations in such an event of a crash result in the outer door handle being deflected and, as a result of this, the external actuation lever 3 also performs a swivel movement clockwise around its axis A.

Due to its inertia, however, the inertia element 6 remains at rest. This means that when transitioning from the basic position or starting position according to FIG. 1 to the event of a crash in the representation according to FIG. 3, the inertia element 6 has not changed its position and also does not perform a swivel movement around its axis B as in normal operation. As a result, the control lever 4 also remains at rest. This is because the control lever 4 is mechanically coupled with the inertia element 6 via the guide pin 11 engaged in the guide recess 12 in the inertia element 6. Thus the clockwise swivel movement of the external actuation lever 3 around the axis A corresponds only to the fact that the coupling lever 5 is swiveled around its axis C on the external actuation lever 3.

During the transition from the starting position according to FIG. 1 to the event of a crash or the crash position according to FIG. 3, the coupling lever 5 actually performs a swivel movement counterclockwise around its axis C, as is evident from a comparison of FIGS. 1 and 3. This swivel movement of the coupling lever 5 counterclockwise around its axis C is thus caused and results in the control pin 9 on the coupling lever 5 being quasi held in the control recess 10 of the control lever 4. This is because the control lever 4 remains at rest like the inertia element 6 in the event of a crash. Since the external actuation lever 3 swivels clockwise around the axis A, this leads the coupling lever 5 to swivel up counterclockwise around its axis C and, at the same time, the pin 7 of its system assumed in normal operation on an edge of the recess 8 in the external actuation lever 3 is swiveled up and leaves this edge.

The counterclockwise movement of the coupling lever 5 around its axis C in crash mode during the transition from FIG. 1 to FIG. 3 now also results in the situation where the coupling lever 5 with its stop arm 5' can no longer interact with the stop edge 2" of the trigger lever 2. This means that the coupling lever 5 is decoupled or disengaged from the trigger lever 2 for the locking mechanism 1. On the other hand, according to FIGS. 1 and 2, normal operation corresponds to the coupling lever 5 being coupled or engaged with the trigger lever 2.

Due to the fact that the actuation lever unit 2, 3, 4, 5 or the external actuation lever 3 in the exemplary embodiment is equipped with the connected elastic damping element 14, 15, 16, which in turn abuts the inertia element 6 or its blockade contour 13 in the event of a crash according to the representation in FIG. 3, a desired vibration damping is observed in the context of the invention. In fact, the elastic coupling between the external actuation lever 3 on the one hand and the inertia element 6 on the other hand via the damping element 14, 15, 16 actually leads to the fact that even minor oscillations or vibrations of the external actuation lever 3 are not transferred or are practically not transferred to the inertia element 6. These vibrations of the external actuation lever 3 are damped instead, and the damping element 14, 15, 16 ensures at the same time that the inertia element 6 remains in its resting position according to the representation in FIG. 3, and any movements of the inertia element 6 are inhibited as desired.

The inertia element 6 retains this quasi-pretensioned guided position, aided by the damping element 14, 15, 16, until the damping element 14, 15, 16 has completely left the blockade contour 13. Thus the control lever 4 and the coupling lever 5 are held longer in their position than in the state of the art according to the representation in FIG. 3, so that the coupling lever 5 cannot act on the trigger lever 2 to open the locking mechanism 1. This results in the overall increase in the described operational reliability, even if the external actuation lever 3, as described, performs vibration movements in the event of a crash.

The invention claimed is:

1. A motor vehicle door lock comprising:

a locking mechanism having a rotary latch and pawl;

an actuation lever mechanism acting on the locking mechanism, wherein the actuation lever mechanism includes an actuation lever;

an inertia element mechanically coupled to the actuation lever;

an elastic damping element which is connected to the actuation lever; wherein the inertia element, during normal operation, follows a movement of the actuation lever and during high accelerations in an event of a crash, the inertia element blocks the actuation lever mechanism from acting on the locking mechanism, wherein during high accelerations, the inertia element remains at rest and the actuation lever rotates causing the damping element to abut the inertia element to dampen vibrations of the actuation lever transmitted to the inertia element, and wherein the damping element abuts the inertia element only during high accelerations to increase inertia;

a coupling lever and a trigger lever, wherein the actuation lever is connectable via the coupling lever to the trigger lever for the locking mechanism; and a control lever, wherein the coupling lever is guided by the control lever.

2. The motor vehicle door lock according to claim 1, wherein the control lever interacts with the inertia element.

3. The motor vehicle door lock according to claim 2, wherein the control lever includes a guide pin and the inertia element includes a guide recess in which the guide pin engages.

4. The motor vehicle door lock according to claim 3, wherein the guide recess is a slit-shaped area that extends radially relative to a rotary axis of the inertia element.

5. The motor vehicle door lock according to claim 1, wherein the actuation lever is formed as an external actuation lever.

6. The motor vehicle door lock according to claim 1, wherein the elastic damping element is a spring.

7. The motor vehicle door lock according to claim 6, wherein the spring is a leg spring with at least one spring leg connected to a base.

8. The motor vehicle door lock according to claim 7, wherein the spring leg is angled in a direction toward the inertia element.

9. The motor vehicle door lock according to claim 7, wherein the spring leg abuts a blockade contour of the inertia element only at high accelerations and is deflected and/or deformed.

10. The motor vehicle door lock according to claim 7, wherein the base includes a plurality of circular windings.

11. The motor vehicle door lock according to claim 7, wherein the spring includes an extension that is connected to the spring leg, wherein the extension is bent at a right angle relative to the spring leg.

12. The motor vehicle door lock according to claim 11, wherein the inertia element includes a blockade contour that is arranged in a first plane that is above or below a second plane in which the extension is arranged, wherein the spring leg abuts the blockade contour during high accelerations.

13. The motor vehicle door lock according to claim 1, wherein the actuation lever and the trigger lever are arranged on a common axis.

14. The motor vehicle door lock according to claim 1, wherein the coupling lever is arranged in a plane that is parallel with a plane in which the trigger lever is arranged.

15. The motor vehicle door lock according to claim 1, wherein the coupling lever has a stop arm that engages a stop edge of the trigger lever.

16. The motor vehicle door lock according to claim 15 further comprising a coupling lever.

17. The motor vehicle door lock according to claim 16 further comprising a control lever, wherein the external actuation lever and the coupling lever are rotatable about a common axis about which the control lever is rotatable.

18. A motor vehicle door lock comprising:

a locking mechanism having a rotary latch and pawl;

an actuation lever mechanism acting on the locking mechanism, wherein the actuation lever mechanism includes an actuation lever;

an inertia element mechanically coupled to the actuation lever;

an elastic damping element which is connected to the actuation lever; wherein the inertia element, during normal operation, follows a movement of the actuation lever and during high accelerations in an event of a crash, the inertia element blocks the actuation lever mechanism from acting on the locking mechanism, wherein during high accelerations, the inertia element remains at rest and the actuation lever rotates causing the damping element to abut the inertia element to dampen vibrations of the actuation lever transmitted to the inertia element, and wherein the damping element abuts the inertia element only during high accelerations to increase inertia; and a coupling lever and a trigger lever, wherein the actuation lever is connectable via the coupling lever to the trigger lever for the locking mechanism, and wherein the actuation lever and the trigger lever are arranged on a common axis.

19. A motor vehicle door lock comprising:

a locking mechanism having a rotary latch and pawl;

an actuation lever mechanism acting on the locking mechanism, wherein the actuation lever mechanism includes an actuation lever;

an inertia element mechanically coupled to the actuation lever; and an elastic damping element which is connected to the actuation lever; wherein the inertia element, during normal operation, follows a movement of the actuation lever and during high accelerations in an event of a crash, the inertia element blocks the actuation lever mechanism from acting on the locking mechanism, wherein during high accelerations, the inertia element remains at rest and the actuation lever rotates causing the damping element to abut the inertia element to dampen vibrations of the actuation lever transmitted to the inertia element, and wherein the damping element abuts the inertia element only during high accelerations to increase inertia;

wherein the elastic damping element is a spring, and the spring is a leg spring with at least one spring leg connected to a base; and wherein the spring includes an extension that is connected to the spring leg, and the extension is bent at a right angle relative to the spring leg.

* * * * *